United States Patent [19]

Fast

[11] Patent Number: 4,739,784

[45] Date of Patent: Apr. 26, 1988

[54] SUN AND WIND SHIELD

[76] Inventor: Paul Fast, 202-1525 West 8th Avenue, Vancouver, British Columbia, Canada, V6J 1T5

[21] Appl. No.: 908,389

[22] Filed: Sep. 17, 1986

[51] Int. Cl.[4] ..... E04H 15/58; E04H 15/36; E04H 15/02; E04H 15/62

[52] U.S. Cl. ..... 135/117; 135/102; 135/96; 135/104; 135/118

[58] Field of Search ..... 135/117, 118, 102, 96, 135/104

[56] References Cited

U.S. PATENT DOCUMENTS

| | | | |
|---|---|---|---|
| 2,142,851 | 1/1939 | Jolly | 135/118 X |
| 2,932,833 | 4/1960 | Wambach | 135/96 X |
| 3,394,720 | 7/1968 | Moss | 135/118 X |
| 4,227,542 | 10/1980 | Bonfilio | 135/118 X |
| 4,404,980 | 9/1983 | Wade | 135/117 X |
| 4,440,187 | 4/1984 | Fiddler | 135/117 |

*Primary Examiner*—J. Karl Bell

*Attorney, Agent, or Firm*—Fetherstonhaugh & Co.

[57] ABSTRACT

A portable, sun and wind shield having a flexible covering material and a collapsible frame for supporting said covering material is disclosed. The collapsible frame is comprised of at least two resilient support members secured at their respective ends by connecting means. An adjustable tensioning means is secured at the connecting means and is adapted to draw together the ends of the resilient support. The covering material is spanned between the resilient support members such that when the resilient support ends are drawn together and rotated in opposite direction about the connecting means, the covering material becomes tautly stretched.

12 Claims, 1 Drawing Sheet

SUN AND WIND SHIELD

FIELD OF THE INVENTION

This invention relates to shields and shelters and more particularly to a wind and sun shield which are portable and easily assembled.

DESCRIPTION OF THE PRIOR ART

The lack of adequate wind protection and shade often diminishes one's enjoyment at the beach. Furthermore, an ever increasing awareness of the detrimental health effects of excessive exposure to the sun is contributing to a rising demand for an inexpensive product that will offer protection against both the sun and wind. A number of shelters and shields have been used in the past. For example, U.S. Pat. No. 4,506,688 which issued to Bethoon et al. discloses a portable shelter which is collapsible and is comprised of a frame adapted to receive and stretch a flexible covering material to form a protective shelter. A tripod support structure is interconnected by a number of pivot points and is required to support the main frame of the shelter.

The shelter requires the use of a multitude of mechanical parts and tubes in order to assemble the shelter.

U.S. Pat. No. 3,405,721 which issued to Crosier et al. discloses a collapsible and portable cabana which is comprised of a U-shaped supporting frame having legs connected at their extremities to pivot and permit the collapsing of the cabana. A flexible waterproof cover is secured to the collapsible frame.

Similarly, a complex number of tubes and mechanical linkages are required to support the waterproof cover.

U.S. Pat. No. 4,355,650 which issued to Beaudry discloses a portable shelter having a stretchable fabric supported over a plurality of framed tubing pivotably mounted to a support point and also includes a number of mechanical linkages to permit the assembly of the shelter. The shelter design still requires a plurality of complex mechanical tubes and linkages even though the main objective of this design is to reduce the complexity found in prior art shelters.

SUMMARY OF THE INVENTION

It is therefore an object of the present invention to provide a wind and sun shield of simple and lightweight construction and of reduced complexity.

Another object of the present invention is to provide a wind and sun shield having an adjustable flexible frame which can be adjusted to vary the shape of the shield.

In yet another object of the present invention is to provide a wind and sun shield with a minimized number of assembly parts.

Accordingly, the present invention provides a portable, sun and wind shield having a flexible covering material and a collapsible frame for supporting said covering material, the improvement comprising: said collapsible frame being comprised of at least two resilient support members secured at their respective ends by connecting means; tensioning means secured at said connecting means and adapted to draw together said ends of said resilient support; said covering material being spanned between said resilient support members such that when said resilient support ends are drawn together and rotated in opposite direction about said connecting means, said covering material becomes tautly stretched.

DRAWINGS

Particular embodiments of the invention will be understood in conjunction with the accompanying drawings in which.

DESCRIPTION OF THE PREFERRED EMBODIMENTS

Figure 1:
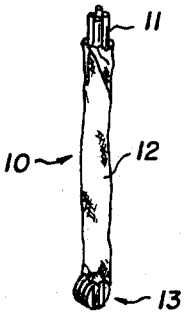
FIG. 1 is an illustrative perspective view of the unassembled shield of the present invention.

Referring now to FIG. 1 we have shown at reference numeral 10 the wind and sun shield of the present invention in its unassembled form with support rods 11 partly covered by fabric 12.

Figure 2:
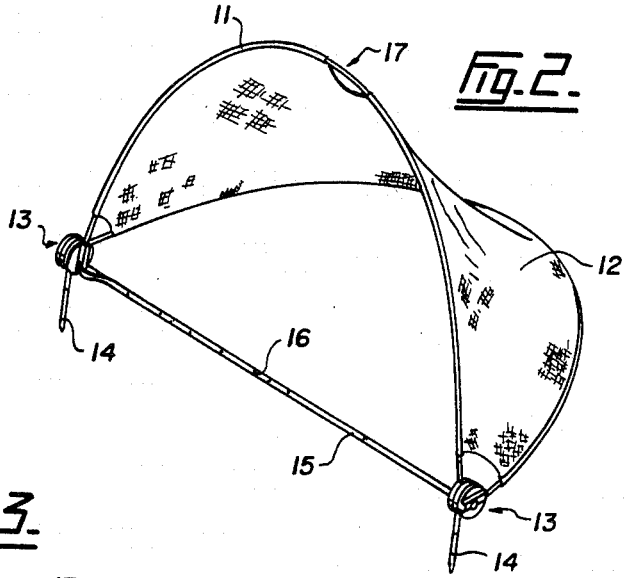
FIG. 2 is a perspective view of the assembled shield according to the present invention.

In FIG. 2, the shield is shown in its assembled form in which an hyperbolic paraboloid shape is achieved through the use of flexible, high strength rods 11 and a fabric 12. Rods 11 can be made of fiberglass material, flexible aluminum or other suitable material. Fabric 12 can be made of nylon or other stretchable or non-stretchable fabric material. The end of the rods are secured together at their respective ends by means of rotatable securing plates 13 which will be further discussed below. A set of pegs 14 can be used to secure or anchor the shield in order to provide additional stability on very windy days. Also, the pegs 14 when used in combination with the connection plates 13 enable the shield to be tilted to various positions. A tension strap 15 is used to retain the shape of the shield by drawing together the ends of the rods. Tension strap 15 can be made of nylon material and provided with a number of snap securing points 16 along the length of the strap. Each rod 11 is comprised of two or more segments which are joined at one end to each other by means of a sleeve and spigot arrangement 17 which facilitates the assembly of the shield as well as reduce its size in its unassembled form.

Figure 3:
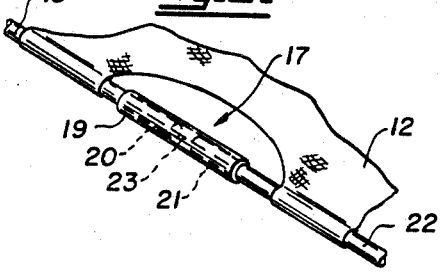
FIG. 3 is a closeup view of a rod securing means according to the present invention.

Referring now to FIG. 3 we have shown a closeup view of the sleeve/spigot arrangement 17. A first segment 18 of a support rod 11 can be provided with a sleeve 19 suitably secured at end 20. The interior diameter of sleeve 20 is such that end 21 of rod segment 22 can be freely inserted therein. An elastic cord, string or wire 23 can be used along the entire length of each hollow rod, and anchored at their ends to keep sleeve 19 closely positioned to end 21 when the shield is in its unassembled form as shown in FIG. 1 and to facilitate assembly of the shield. The sleeve 19 can also be made an integral part of either rod segments 18 or 22.

Figure 4:
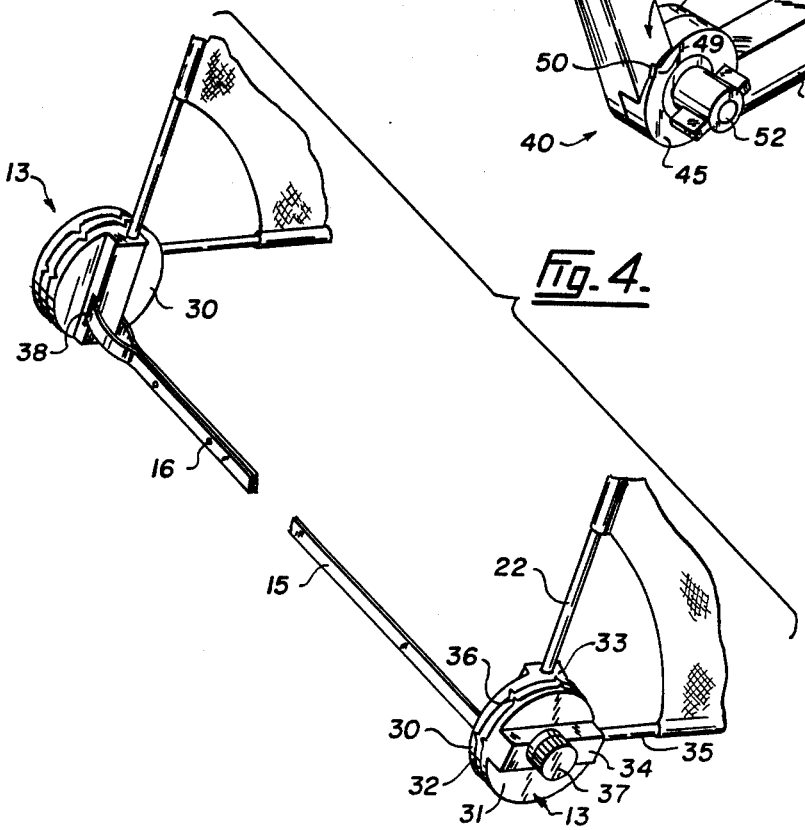
FIG. 4 is an illustrative closeup view of an adjustable connector used in the present invention.

Referring now to FIG. 4 we have shown a closeup view of the rod connecting arrangement shown in FIG. 2 at reference numeral 13. The rod connecting means 13 is comprised of an inner and outer rotating disks 30 and 31 which, when anchoring pegs are used, can be integral with disk 30 is a receptacle 33 having an aperture adapted to receive an end of rod segment 22. Similarly, disk 31 is provided with a receptacle 34 having an aperture adapted to receive an end of rod segment 35. Each disk can be provided with a plurality of matching ribs and grooves 36 which extend radially from a central aperture through which is inserted a threaded bolt 37 used to secure the disk together. Disk 32 can be provided with a receptacle adapted to receive anchoring pegs 14 as shown in FIG. 2. Pegs 14 can also be replaced by a third intermediate rod that would provide more headroom space beneath a shield by flattening nylon fabric 12.

Each inner disk 30 is provided with a slot opening 38 adapted to receive a tensioning strap 15. Although fastening snaps 16 are used to provide the required tension to nylon strap 15 other suitable fastening means could be used as well.

The shield is set up from the unassembled form shown in FIG. 1, by unravelling fabric 12, connecting the individual rod segments to provide the support rods, feeding a free end of tensioning strap 15 through slot 38 of the connecting means 13 such that the arch profile of the rods can be adjusted by tensioning the strap accordingly. Once the arched shape is obtained, the support rods are rotated in opposite directions to finally create the required shape.

Figure 5:
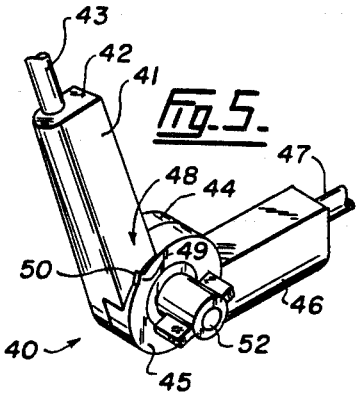
FIG. 5 is another embodiment of the adjustable connector shown in FIG. 4.

FIG. 5 shows another embodiment of the adjustable rod connector. Connector 40 is comprised of an elongated rod receptacle 41 adapted to receive at end 42 a first supporting rod 43. Integral with said receptacle is a disk 44 in abutting relationship with an adjacent disk 45 of another elongated rod receptacle 46 which is adapted to receive an end of support rod 47. Disks 44 and 45 are each rotatable with respect to each other.

Both connectors are snapped into their open position, shown in FIG. 5, by using a rib and groove assembly 48 located on each disk. That is, disk 45 is provided with a rib 49 which will engage with a matching groove 50 located on disk 44 on lower arcuate shaped end of rod receptacle 41. Similarly, but not shown, disk 44 is provided with a rib adapted to be received in a groove of rod receptacle 46.

A winged nut/bolt assembly 52 can provide additional friction between the two disks, particularly if pegs 14 are used for positioning the shield in a tilted position.

I claim:

1. A portable, sun and wind shield adapted to provide a variety of profiles and having a flexible covering material and a collapsible frame for supporting said covering material, the improvement comprising:

said collapsible frame being comprised of two resilient support members secured together at their respective ends by securing means, each of said support members being made of connecting segments having joining means at each end to permit a first segment to be joined to an adjacent one;

a connecting cord disposed between adjacent ends of said connecting segments to aid the joining of one segment to another;

adjustable tensioning means secured at said securing means and adapted to draw together said ends of said resilient support so as to vary the profile of said shield;

said covering material being spanned between said resilient support members such that when said resilient support ends are drawn together and said supports rotated in opposite direction about said securing means, said covering material becomes tautly stretched.

2. A portable shield as defined in claim 1 wherein said connecting cord is loosely disposed in said segments between adjacent ends of a first and second segment.

3. A portable shield as defined in claim 2 wherein said joining means comprises a sleeve at a first end of each connecting segment and a spigot at the opposite end such that adjacent segments are joined by inserting the spigot end of one segment into the sleeve end of the adjacent segment.

4. A portable shield as defined in claim 3 wherein tensioning means consists of an adjustable strap secured to one of said securing means and adapted to be secured to an opposite securing means.

5. A portable shield as defined in claim 4 wherein and securing means comprises a first and second connecting plate rotatable relative to each other and each having a receptacle for receiving a spigot end of said connecting segments, said plates having tightening means to restrict the rotation of said plates when said shield is open.

6. A portable shield as defined in claim 5 wherein said connecting means further includes a third plate in abutting relationsip with said first and second plates and adapted to receive a support peg for securing said shield to ground.

7. A portable shield as defined in claim 6 wherein said plates further include grooves and ridges on abutting surfaces of said plates.

8. A portable shield as defined in claim 7 wherein said tightening means includes a threaded nut and bolt received in a central aperture of said plates.

9. A portable shield as defined in claim 8 wherein said connecting segments consist of fiberglass rods.

10. A portable shield as defined in claim 8 wherein said connecting segments consist of flexible aluminum rods.

11. A portable shield as defined in claim 8 wherein said connecting cord comprises an elastic cord loosely connecting said sleeve end of one rod to the spigot end of an adjacent rod.

12. A portable shield as defined in claim 8 wherein said connecting plates are each integrally connected with an elongated receptacle adapted to receive the spigot end of a connecting segment.

* * * * *